US006811112B1

(12) United States Patent
Currie et al.

(10) Patent No.: US 6,811,112 B1
(45) Date of Patent: Nov. 2, 2004

(54) ACTIVE FEEDBACK LEVELWINDING SYSTEM

(75) Inventors: Tim Currie, Panama City Beach, FL (US); James Brackett, Panama City, FL (US); Katherine Brackett, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 137 days.

(21) Appl. No.: 10/342,661

(22) Filed: Jan. 14, 2003

(51) Int. Cl.[7] ..... B65H 18/08

(52) U.S. Cl. ..... 242/534.1; 242/548.1; 242/157.1; 242/615.2; 254/271

(58) Field of Search ..... 242/548, 548.1, 242/157.1, 534, 534.1, 615.2, 615.3; 254/268–273, 333

(56) References Cited

U.S. PATENT DOCUMENTS 4,038,127 A * 7/1977 Bullock et al. ..... 156/353
4,695,010 A * 9/1987 Smith ..... 242/478.2
4,795,108 A * 1/1989 Appling ..... 242/157.1
RE32,967 E * 6/1989 St. John et al. ..... 242/534.1
5,437,082 A * 8/1995 Maenaka ..... 28/190
5,551,545 A * 9/1996 Gelfman ..... 191/12.2 A
5,664,765 A * 9/1997 Pickrell ..... 254/271
5,783,007 A * 7/1998 Boyd et al. ..... 156/64
5,988,596 A * 11/1999 Mitchell et al. ..... 254/271
6,443,431 B1 * 9/2002 Stasny et al. ..... 254/385
6,629,663 B1 * 10/2003 Bettendorf ..... 242/534

* cited by examiner

*Primary Examiner*—Emmanuel Marcelo
(74) *Attorney, Agent, or Firm*—James T. Shepherd; Donald G. Peck

(57) ABSTRACT

An active feedback levelwind apparatus and method for winding cable on a drum has a rotary encoder providing signals representative of drum rotation and a shuttle adjacent the drum receives, bidirectionally moves and wraps the cable on the drum. An outboard sensor assembly on the shuttle has an angular sensor providing signals representative of the angle of extension of an outboard extending portion of the cable. An inboard sensor assembly on the shuttle has an inboard sensor providing signals representative of the angle of extension of an inboard extending portion of the cable. A stepper motor coupled to a computer system bidirectionally displaces the shuttle and cable in response to the rotation signals, outboard angular signals, inboard angular signals and limit signals to smoothly wind the cable. Error position feedback signals from the computer system create corrective displacements for the shuttle to smoothly wind cables of varying widths.

36 Claims, 5 Drawing Sheets

ACTIVE FEEDBACK LEVELWINDING SYSTEM

STATEMENT OF GOVERNMENT INTEREST

The invention described herein may be manufactured and used by or for the Government of the United States of America for governmental purposes without the payment of any royalties thereon or therefor.

REFERENCE TO COMPUTER PROGRAM LISTING APPENDIX

The invention incorporates by reference herein the material of the file identified as "EF14" included herewith on one compact disc.

BACKGROUND OF THE INVENTION

The invention relates to the field of devices for stowing cables. More specifically, to a method for guiding and stowing cable of varying width on a rotating drum.

Levelwinding systems have been used on cable handling systems for many years to smoothly guide cable of uniform width onto storage drums. These systems were mechanical in nature and had to be designed for a cable of a particular width. In general a mechanical system would have a sprocket gear mounted on one side of the drum that transferred the rotations of the drum via a chain drive to the levelwind. The rotations were transferred to the levelwind diamond screw that moved a shuttle back and forth across the face of the drum. The cable would pass through rollers on the shuttle and be guided onto the drum. The levelwind speed was set by the gear ratio of the chain drive as well as the pitch of the diamond screw and could not be dynamically changed. In a mechanical levelwind if the width of the cable changed, the system would have to have some mechanical redesign to the gears or diamond screw to accommodate the new width of the cable by speeding up or slowing down the levelwind shuttle. With a cable that has a varying width the drum was usually segmented and the levelwind system required interaction with the operator. The shuttle levelwinds back-and-forth on the first segment of the drum. When the wider width cable needs to be wrapped, the operator would manually transition the shuttle to the next segment of the drum.

Cables that are designed to tow devices, such as a sonar array, through the water are generally faired. Fairing on the cable reduces drag and strumming of the cable as it is towed through the water. Strumming can damage or break the cable and damage or negatively interfere with the device that is being towed. There are two types of fairing used in marine cables, soft fairing and hard fairing. A cable that has soft fairings, such as plastic ribbon or fiber "hairy" fairing, can cause unpredictable gapping during wrapping due to bunching up of the fairing in a random fashion.

Cable that has hard fairing is traditionally wrapped on a segmented, grooved drum to prevent slipping or leaning of the hard fairing. When hard-faired cable is wrapped on top of a previous layer of cable or on a smooth drum surface, slipping or leaning of the fairing produces random gaps in the wrap. For this reason hard-faired cable is not traditionally wrapped over bare or soft-faired cable. In either case a mechanical levelwinding system has no way of compensating for these conditions.

Thus, in accordance with this inventive concept, a need has been recognized in the state of the art for a system to guide a cable onto a rotating drum to prevent the cable from bunching unevenly on the drum or gapping and to accommodate cable of varying width.

SUMMARY OF THE INVENTION

An object of the invention is to provide a system to guide a cable onto a rotating drum to prevent the cable from bunching unevenly on the drum or gapping between adjacent wraps.

Another object of the invention is to provide a system to accommodate cable of any width on a rotating drum.

Another object of the invention is to provide a system to accommodate a cable of varying width such as a marine cable that is faired on a rotating drum.

Another object is to provide a system to accommodate changes in the geometry of the system's cable by functionally altering the operation of a levelwind mechanism via a simple programmed change instead of a costly mechanical redesign.

Another object is to provide a system to utilize active feedback to maintain a shuttle in its optimal position for a smooth wrap of cable on a rotating drum.

Another object is to provide a feedback system to detect and give alerts of a potentially dangerous condition to operators if a cable being wrapped develops gaps or bunches.

Another object is to provide a system having significant weight and size reductions over contemporary mechanical designs.

Another object is to provide a system eliminating the need for a heavy, expensive grooved drum by allowing hard-faired cable to be wrapped on top of bare or soft-faired cable.

Another object is to provide a programmable stepper motor to guide a cable of varying width on and off a rotating storage drum in smooth and orderly fashion to maximize the storage capacity of the drum.

Another object is to provide a levelwind system utilizing feedback sensors to monitor the position of incoming cable.

Another object is to provide a levelwind system making correction movements of a levelwind shuttle when an incoming cable assumes a different geometry.

Another object is to provide a system using a relatively small and inexpensive stepper motor, instead of hazardously exposed chain and gear drives that should be covered to protect the operators from injury, to reduce size, weight, and cost as compared to conventional mechanical systems.

Another object is to provide a system having a conventional computer providing visual graphical interfaces for the operator to provide real-time indications of the cable wrapping process.

Another object is to provide a system to using cost effective, proven off-the-shelf consumer technology that can be purchased from numerous vendors.

These and other objects of the invention will become more readily apparent from the ensuing specification when taken in conjunction with the appended claims.

Accordingly, the present invention is an apparatus and method to wind cable on a drum. A rotary encoder provides signals representative of rotation of the drum and a platform adjacent to the drum has a shuttle receiving the cable and can be bidirectionally moved to wrap the cable on the drum. A limit switch at each end of the platform provides a limit signal when contacted by the shuttle. An outboard sensor assembly on the shuttle extends outboard to receive an outboard extending portion of the cable and has an outboard angular sensor providing signals representative of its angular extension. An inboard sensor assembly on the shuttle extends inboard to receive an inboard extending portion of the cable and has an inboard angular sensor providing signals representative of its angular extension. A computer responsive to the outboard and inboard sensor signals generates error position feedback signals and is connected to a stepper motor coupled to the shuttle to bidirectionally displace the shuttle and the cable in response to the rotation signals, limit signals, outboard angular signals and inboard angular signals to smoothly wind the cable that may be of varying width.

BRIEF DESCRIPTION OF THE DRAWINGS

In all figures like characters refer to like structures.

DESCRIPTION OF EMBODIMENTS

Figure 1:
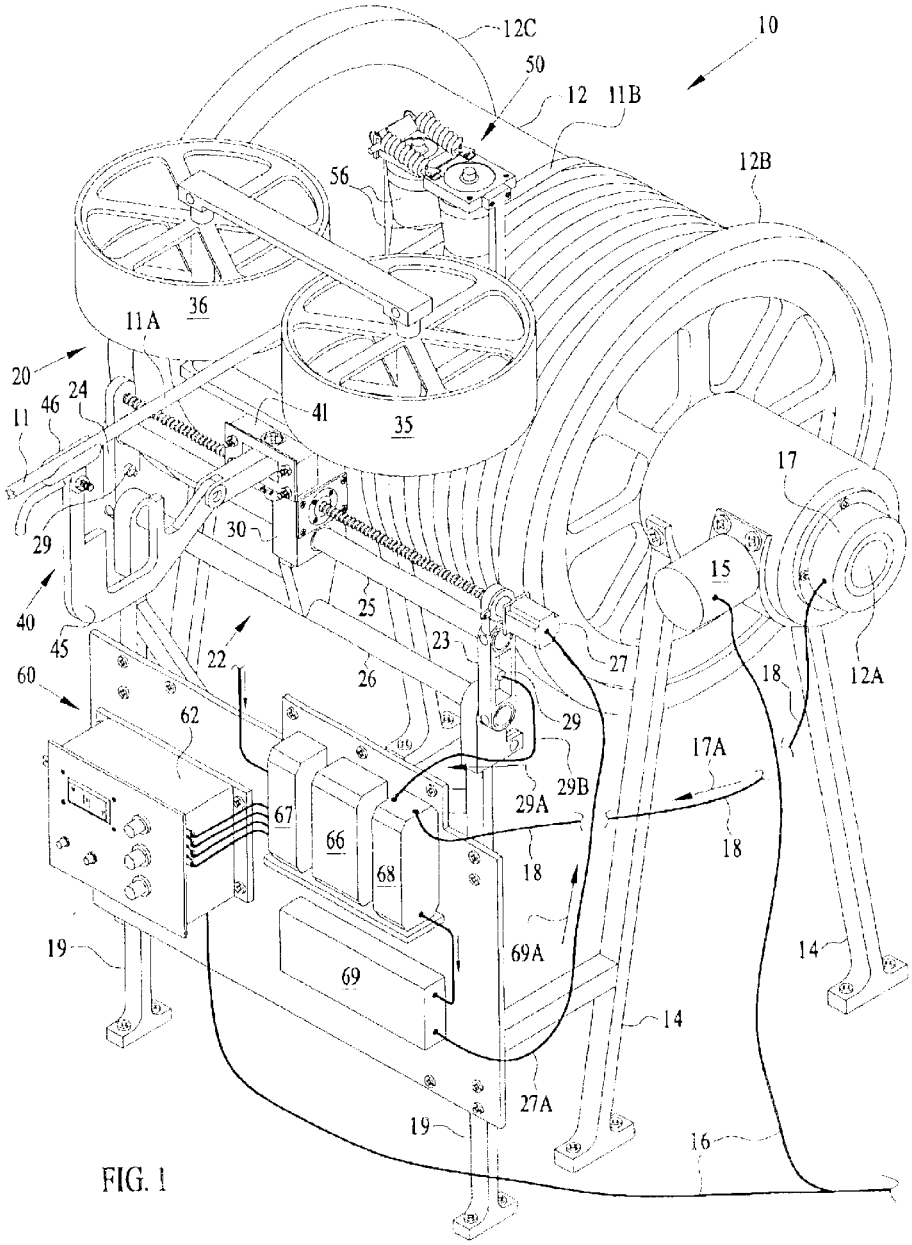
FIG. 1 is an isometric depiction of the levelwind system of the invention.
Figure 2:
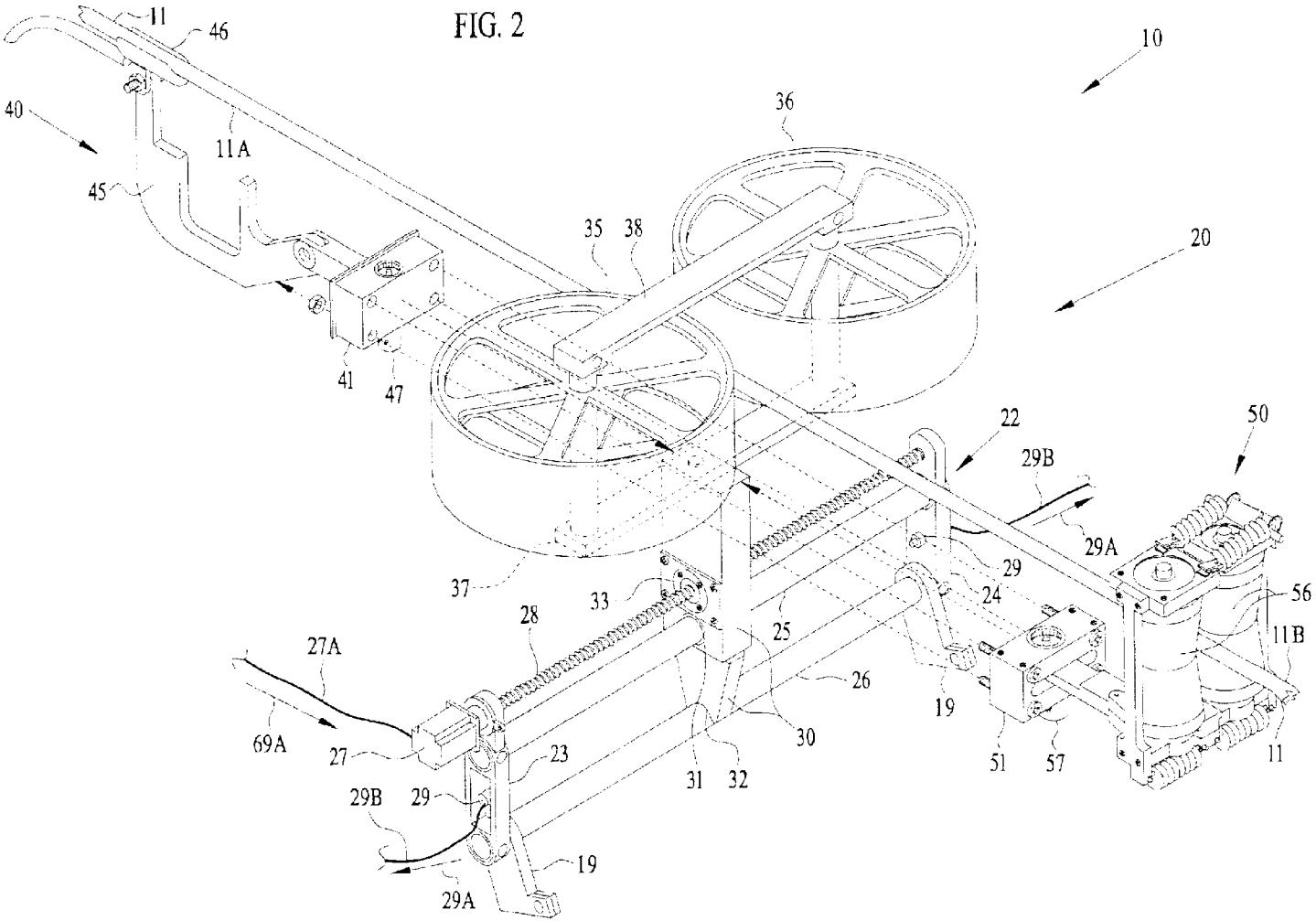
FIG. 2 is a partially exploded view showing the inboard sensor assembly and the outboard sensor assembly separated from the rest of the levelwind assembly to show details thereof.

Referring to FIGS. 1 and 2, active feedback levelwind system 10 of the invention guides and wraps a cable 11 onto a rotating drum 12 in such an even way as to prevent it from bunching unevenly or gapping (producing gaps between adjacent wraps of cable 11) on drum 12. Levelwind system 10 smoothly wraps cable 11 having different widths and, more specifically, cable 11 that may be compound and be of varying widths.

Drum 12 is mounted at opposite ends on a deck 13 or other solid base via a pair of V-shaped frames 14 that provide rotative support for drum 12. Drum 12 deploys and retrieves many feet, or meters of cable 11 when bidirectionally rotated by an interconnected motor 15 mounted on one V-shaped frame 14. A lead 16 from motor 15 extends to supply power from a source of power (not shown) for rotating drum 12. A rotary optical encoder 17 is suitably coupled to a shaft 12A of drum 12 to detect rotations of drum 12 and feed digital signals 17A representative of these rotations over a lead 18.

A framework 19 is located adjacent to drum 12 on deck 13 and is connected to a platform 22 of a levelwind assembly 20 of levelwind system 10. Platform 22 has a pair of essentially vertical members 23, 24 connected to framework 19 and to opposite ends of upper and lower guide shaft 25, 26.

A stepper motor 27 is mounted on vertical member 23 and is connected to one end of a threaded ball screw 28. Ball screw 28 extends through upper parts of vertical members 23, 24 and rotates in opposite directions when bidirectionally rotated by stepper motor 27. A limit switch 29 on each of vertical members 23, 24 produces a limit signal 29A on lead 29B when contacted by a shuttle 30 of levelwind assembly 20.

Shuttle 30 guides cable 11 along drum 12 and has a lateral bore 31 sized to accommodate upper guide shaft 25 and a lower recess 32 sized to accommodate lower guide shaft 26. The sizes of lateral bore 31 and lower recess 32 permit and guide sliding linear displacements of shuttle 30 on shafts 25, 26. Shuttle 30 has a ball screw guide nut 33 having mating threads that slideably ride on, or engage the threads of threaded ball screw 28. Bidirectional rotations of ball screw 28 by stepper motor 27 create responsive linear bidirectional displacements of guide nut 33 and shuttle 30. These liner displacements progress in one direction until shuttle 30 contacts limit switch 29 on either of vertical members 23, 24. Then, the impacted limit switch 29 produces a limit signal 29A to create a reversal of the direction of rotation of stepper motor 27. This reversed direction of rotation of stepper motor 27 rotates ball screw 28 in the opposite rotational direction to displace shuttle 30 in the opposite linear direction until the other limit switch 29 is contacted, and this reversal procedure is repeated.

Levelwind assembly 20 also has a pair of guide rollers 35, 36 to contact and guide cable 11 between them and over shuttle 30 as it is coiled on and uncoiled from drum 13. Guide rollers 35, 36 are sized such that cable 11 does not get bent below its minimum bend radius. Guide rollers 35, 36 are rotatively mounted on a lower rigid cross-piece 37 secured to shuttle 30. Guide rollers 35, 36 also are rotatively mounted to an upper rigid cross-piece 38 on their opposite sides to assure structural integrity.

Figure 3:
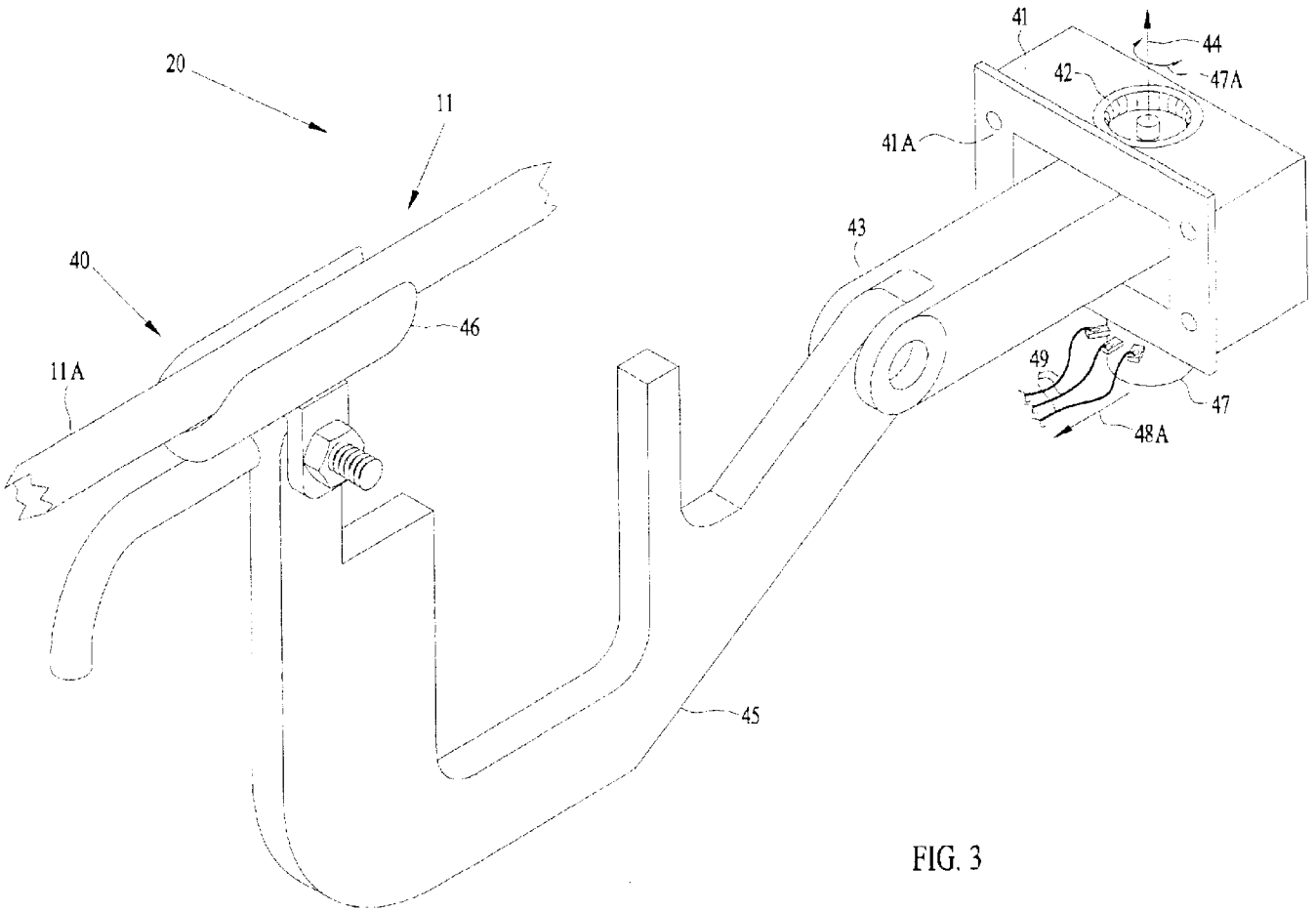
FIG. 3 shows details of the outboard sensor assembly.
Figure 4:
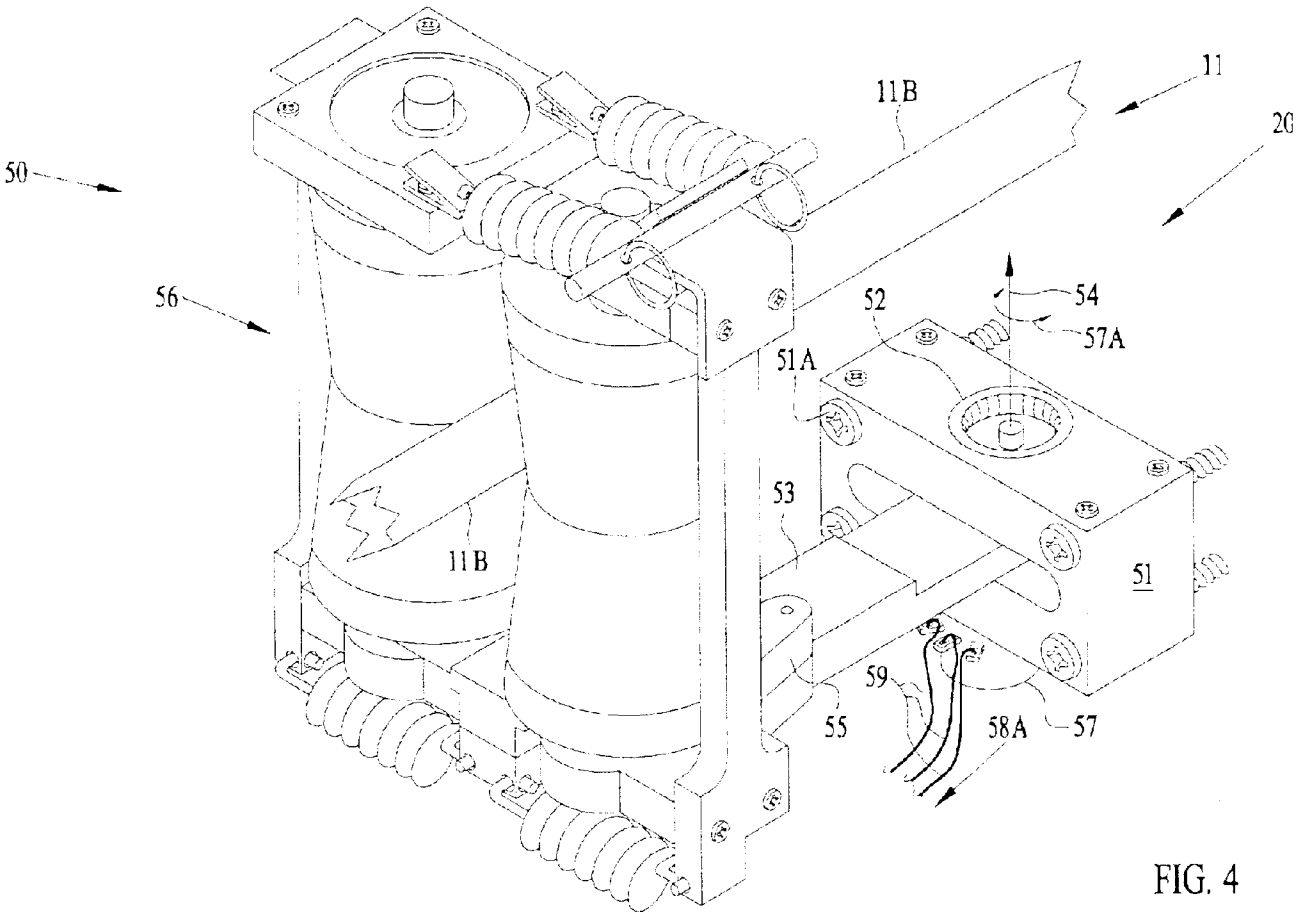
FIG. 4 shows details of the inboard sensor assembly.

Referring in addition to FIGS. 3 and 4, an outboard sensor assembly 40 and an inboard sensor assembly 50 of levelwind assembly 20 are bolted or otherwise secured to shuttle 30 via a pivot block 41 and pivot block 51, respectively. Pivot block 41 has a bearing 42 to retain, support and permit pivotal, or angular displacement of a guide arm 43 about an axis 44 of bearing 42. An arm extension 45 of guide arm 43 has a cable follower 46 shaped and sized to receive and guide an outboard extending portion 11A of cable 11. Guide arm 43, arm extension 45, and cable follower 46 normally extend vertically from surface 41A of pivot block 41. A rotational, or angular sensor 47 for cable 11 extends through pivot block 41 and is connected to guide arm 43. Angular, or angle sensor 47 creates analog sensor signals 48A on output leads 49 that are representative of the angular displacement (shown as bidirectional arrow 47A) of bearing 42, follower 46, arm extension 45 and guide arm 43 about vertical axis 44. A typical angular sensor 47 could be a Clarostat 100 OHM potentiometer commercially marketed by Clarostat Sensors and Controls Inc., 12055 Rojas Drive, Suite K, El Paso, Tex. 79936. Angular displacements 47A of angular sensor 47 are caused by outboard extending portion 11A of cable 11 as it extends to the left or right of the normal vertical extension of follower 46, arm extension 45 and guide arm 43 from surface 41A of pivot block 41, and cable 11 displaces follower 46, extension 45 and arm 43 to coextend with it. In other words, sideways displacements of cable follower 46 by cable 11 cause the interconnected angle sensor 47 to produce outboard analog signals 48A on leads 49 that are proportional to the angular displacements 47A of cable 11 with relation to rest of levelwind assembly 20.

Inboard sensor assembly 50 has pivot block 51 on shuttle 30 and has a bearing 52 to retain, support and permit pivotal, or angular displacement of a guide arm 53 about an axis 54 of. bearing 52. An arm extension 55 of guide arm 53 has a pair of spring-loaded rollers 56 functioning as a follower that receives an inboard extending portion 11B of cable 11 as it is wound onto or unwound from drum 12. Guide arm 53 and arm extension 55 normally extend vertically from surface 51A of pivot block 51. A rotational, or angular sensor 57 extends through pivot block 51 and is connected to guide arm 53. Angular sensor 57 creates signals 58A on its output leads 59 that are representative of the angular displacements (shown as bidirectional arrow 57A) of guide arm 53 and arm extension 55 around axis 54 of bearing 52. A typical angular sensor that could be used as sensors 57 could be a Clarostat 100 OHM potentiometer commercially marketed by Clarostat Sensors and Controls Inc., 12055 Rojas Drive, Suite K, El Paso, Tex. 79936. Angular displacements 57A of angular sensor 57 are caused by inboard extending portion 11B of cable 11 as it extends from drum 11 between rollers 56 and displaces rollers 56, arm 53 and extension 55 to coextend in alignment with it. These angular displacements 57A are to the left or right of the normal vertical extension of guide arm 53 and arm extension 55 from surface 51A of pivot block 51. In other words, cable 11 passes through spring-loaded rollers 56 which displace extension 55 and pivot guide arm 53 producing inboard analog signals 58A from angular sensor 57 that are proportional to the angular displacements 57A of inboard extending portion 11B of cable 11 extending from rollers 56 to the leading wrap on drum 12. Both analog angular displacement signals 48A, 58A from outboard and inboard angular sensors 47, 57 are respectively coupled via leads 49, 59 to an analog to digital converter 67 of computer system 60.

Figure 5:
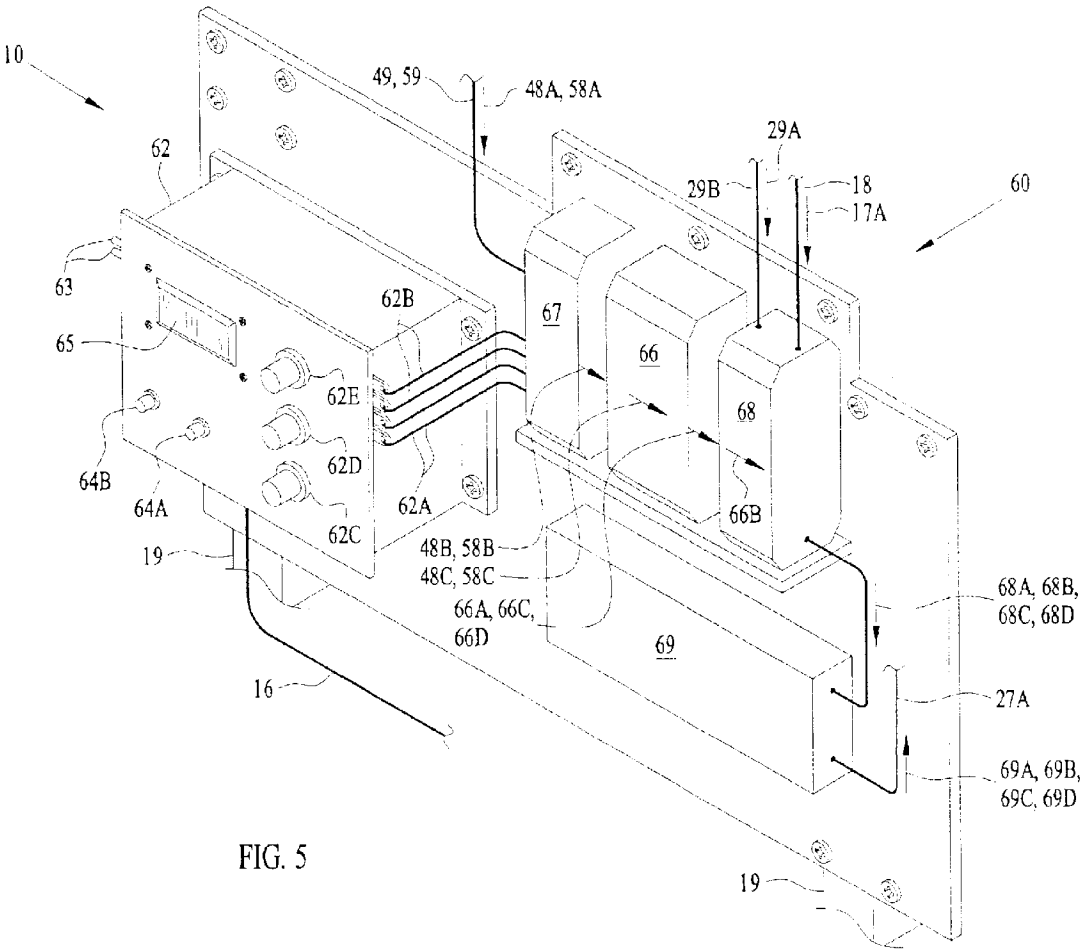
FIG. 5 shows details of the computer system.

Referring to FIG. 5, Active feedback levelwinding system 10 has computer system 60 mounted on framework 19 and connected to power cable 16. Computer system 60 has a control box 62 connected to power cable 16 and power and data leads 62A, 62B connected to an interconnected computer 66, analog to digital converter 67, and stepper motor controller 68 that can be protected in a housing (not shown). Control box 62 has interface couplings 63 to load the memory of computer 66 and to retrieve any error codes generated for troubleshooting. Computer 66 is an embedded system that is programmed and communicated with via a serial port connected to a laptop computer (not shown). In other words, programs can be created on the laptop and transferred (downloaded) to computer 66. In addition, error files generated during operation can be uploaded from computer 66. A power switch 64A for control box 62 is rated for activation of levelwind system 10, and a jog switch 64B can be used by an operator to manually jog, or move shuttle 30 to the left or right if it is out of position on drum 12 at startup. A large liquid crystal display (LCD) 65, such as a 4×20 LCD on COMI on the front of control box 62 can display the amount of cable deployed, any error messages generated, and other data needed for successful operation.

Computer 66 can be any of many contemporary personal computers, an Arcom AIM104-386EX PC104 for example, that can have its memory loaded,-or programmed with an appropriate routine for set up and for levelwinding cable 11 on drum 12. A suitable routine in accordance with this invention is identified as "EF14" and is included on the disc referred to hereinabove to assure smooth winding of differently dimensioned cable 11 by active feedback levelwind system 10.

Digital rotation signals (optical encoder signals) 17A from optical encoder 17 are connected over lead 18 to motor controller card 68; analog outboard signals 48A and analog inboard signals 58A from outboard angular sensor 47 and inboard angular sensor 57 are connected to analog to digital converter 67 that converts them to digital outboard and inboard signals 48B, 58B, respectively, and connects these digital outboard and inboard signals 48B, 58B to computer 66; optical encoder signals 17A and limit switch signals 29A are connected to dedicated inputs on motor controller card 68. Inboard and outboard angular signals 58B, 48B brought in through A/D converter 67 are processed by computer 66.

Stepper motor controller 68 generates responsive stepper motor control signals 68A that are fed to stepper motor driver 69. Stepper motor controller 68 can be an OMS PC68 motor controller card associated with computer 66 to generate stepper motor driver signals 68A. Stepper motor control signals 68A are fed to stepper motor driver 69 that creates responsive stepper motor driver signals 69A at the proper polarity and magnitude to appropriately rotate stepper motor 27. Stepper motor driver signals 69A are coupled to stepper motor 27 over lead 27A to rotate stepper motor 27 and rotate threaded ball screw 28 in either direction to linearly displace shuttle 30 and outboard and inboard portions 11A, 11B of cable 11 along drum 12.

Encoder rotation signals 17A sent over lead 18 to motor controller 68 create responsive stepper motor driver signals 69A in stepper motor driver 69 and effect step and directional displacements of stepper motor 27. The combination of computer 66 and stepper motor controller 68 has been programmed to cause the rotations of stepper motor 27 to follow the rotations of drum 11 at a predetermined ratio. For example, the routine programmed in computer 66 can command stepper motor 27 to rotate 3.2 times for every 1 rotation of drum 12 as indicated by signals 17A. This ratio is a programmable variable and can be commanded, or changed as needed to adjust to when cable 11 has varying widths by speeding up or slowing down the linear displacement of shuttle 30 and cable 11 guided thereon. Computer 66 can query stepper motor controller 68 for the current encoder count and can convert this value into a representation of distance corresponding to the amount of cable 11 deployed or hauled in, and this distance can be displayed in feet or meters on LCD display 65 on control box 62.

Levelwind feedback system 10 of the invention has interrelated mechanical systems, sensor devices, motors including motor 15 to rotate drum 12 and stepper motor 27 to reciprocally displace shuttle 30, and computer control system 60 operatively links them all together. Supporting frame 14, framework 19, and platform 22 of the mechanical systems support and couple drum 12 and adjacent levelwind assembly 20 together. Framework 19 and platform 22 securely position the other constituents of levelwind assembly 20 to transmit rotary motion from stepper motor 27 and convert the rotary motion into linear displacements of other constituents of levelwind assembly 20.

As drum 12 is rotated, levelwind assembly 20 moves sideways in a controlled motion to lay cable 11 in an orderly fashion on drum 12. Optical encoder rotation signals 17A are sent to stepper motor controller 68 that transmits stepper motor control signals 68A to stepper motor driver 69. Stepper motor driver 69 sends responsive stepper motor driver signals 69A to stepper motor 27 to rotate it and move shuttle 30 along guide shafts 25, 26. Limit switches 29 located on vertical members 23, 24 at the ends of guide shafts 25, 26 are at the limits of the linear travel of shuttle 30 along drum 12. When shuttle 30 contacts either of limit switches 29, the actuated limit switch 29 sends a digital limit signal 29A to motor controller 68. Receipt of limit signal 29A at motor controller 68 causes it to initiate a limit control signal 66B that creates a responsive stepper motor control signal 68B. Signal 68B is connected to driver 69 to allow creation of a driver signal 69B for stepper motor 27 that changes its direction of rotation. Changing the direction of rotation of stepper motor 27 changes the direction of linear motion of shuttle 30 to the opposite, or reciprocal direction. During the displacement of shuttle 30, outboard sensor assembly 40 and inboard sensor assembly 50 measure the angles that cable 11 makes with respect to shuttle 30 and drum 12 and transmit outboard angular sensor signals 48A and inboard angular sensor signals 58A (that are digitized as signals 48B, 58B) to computer 66. These signals 48B, 58B are averaged as signals 48C, 58C in computer 66 as elaborated on below. Computer 66 can use averaged signals 48C, 58C to determine, or create error position feedback signals 66C from the routine in computer 66. This routine enables computer 66 to determine whether or not signals 48A, 58A (and averaged signals 48C, 58C) are generated from sensors 47, 57 at angular positions outside of positions within an optimal spatial relationship between shuttle 30 and the leading wrap of cable 11 for smooth wrapping of cable 11 on drum 12. These error position feedback signals 66C can be used to modify or change the linear motion of levelwind assembly 20 to compensate for anomalies in a portion of cable 11 to enable smooth wrapping.

When active feedback levelwind system,10 is powered up via switch 64A of control box 62, computer 66 initializes stepper motor controller 68 and driver 69 to command stepper motor 27 to follow the rotations of drum 12 (as indicated by signals 17A from rotary encoder 17) at a predetermined ratio. Thus, shuttle 30 moves across the face of drum 12 at a theoretical optimal speed to allow each wrap of cable 11 to lie next to the previous, or leading wrap. At four programmable positions during a single wrap, for example at 90°, 180°, 270°, 360°, analog to digital converter 67 is commanded by computer 66 to take a series of 5 readings of the analog form of error feedback signals 58A from inboard angular sensor 57 and 5 readings of the analog form of outboard angular signals 48A from outboard angular sensor 47 and provide representative digital values 48B, 58B. To provide a stable angle measurement of each angular sensor 47, 57, computer 66 averages these 5 readings to single digitized values 48C, 58C for outboard angle signals and inboard angle signals 48A, 58A (digitized signals 48B, 58B). The averaged outboard and inboard angular sensor signals 48C, 58C are both processed with an algorithm in computer 66 to determine if cable 11 is in contact with one of guide rollers 35, 36, and if so, which roller, or is not in contact with a roller.

Based on averaged values 48C, 58C, the routine of the algorithm in computer 66 can determine that cable 11 is not in contact with one of guide rollers 35, 36. Stepper motor controller 68 sends control signals 68A to driver 69 that sends appropriate driver signals 69A to stepper motor 27 that immediately increases the following ratio, the ratio of revolutions of stepper motor 27 to rotations of drum 12. Ball screw 28 moves shuttle 30 quickly to cause one of guide rollers 35, 36 to be in contact with cable 11. This contacting condition between cable 11 and one of rollers 35, 36 is determined in computer 66 by comparing signals 48C, 58C and values preprogrammed into memory by the program in computer 66. By having cable 11 in contact with one of guide rollers 35, 36, positive control of cable 11 by levelwind assembly 20 is maintained.

Shuttle 30 is generally positioned a small distance behind the leading wrap of cable 11 already on drum 12. This positioning allows for the incoming lengths, or inboard portions 11B of cable 11 to fall at least partially on top of the leading wrap of cable 11 on drum 12 and roll off of cable 11 to a position snugly against the leading wrap. This later placed wrap then becomes the leading wrap for the next wrap.

The distance, or position that shuttle 30 follows behind the leading wrap of cable 11 on drum 12 is dependant on the type of cable 11 being wrapped. When cable 11 is determined to be bare, i.e. no hard or soft fairing, shuttle 30 positions the incoming length of cable 11 a distance about equal to half the diameter of cable 11 behind the leading wrap of cable on drum 12 for optimal wrapping. Cables 11 having any type of fairing generally need shuttle 30 to follow closer behind the leading wrap than a bare cable. This following could be less than one-half the diameter of a paired cable 11. Fairing on cable 11 can cause the incoming wrap not to fall next to the leading wrap but instead to ride up and over the top of the leading wrap resulting in bunching of the cable. When outboard and inboard angle signals 48A, 58A from outboard and inboard angular sensors 47, 57 are received in computer 66 and the algorithm in computer 66 indicates that one of guide rollers 35, 36 is in contact with cable 11, the averaged signals 48C, 58C of signals 48A, 58A are used to determine whether shuttle 30 is in the optimal position for a smooth wrap. The average signal values 48C, 58C are compared against values preprogrammed into memory of computer 66. The preprogrammed values relate to dimensions of the type of standard cable present at a particular point in the standard cable.

The comparison made in computer 66 between the averaged signals 48C, 58C and the values preprogrammed in memory enables computer 66 to make a determination as to whether shuttle 30 is ahead, behind, or in an optimal position, (an optimal spatial relationship between shuttle 30 and the leading wrap of cable 11 on drum 12). If signals 48C, 58C indicate that shuttle 30 is in optimal position for smooth winding of cable 11, no action or error position feedback signal 66C is produced by computer 66, and following continues normally. In this context, following means that shuttle 30 follows the leading wrap of cable at a predetermined spacing found to be optimum for adjacent and nearly contiguous wrapping of cable 11 on drum 12. Computer 66 continues to produce rotational control signals 66A that create the same rate of rotation of stepper motor 27.

When, however, averaged signals 48C, 58C from signals 48A, 58A from outboard and inboard angle sensors 47, 57 indicate to computer 66 that shuttle 30 is too far ahead with respect to the leading wrap of cable 11 on drum 12, then following is halted. This condition might result from a length of cable 11 between rollers 35, 36 being thinner, or of less width than the length of cable 11 already wound in the leading wrap on drum 12. Computer 66 creates error position feedback control signals 66C and sends these signals to the motor controller card of stepper motor controller 68. Stepper motor controller 68 sends stepper motor error feedback control signals 68C to stepper motor driver 69 that couples appropriate error position feedback driver signals 69C to jog stepper motor 27 back. These driver signals 69C jog back stepper motor 27 very quickly so that ball screw 28 moves shuttle 30 (and cable 11) back a predetermined distance very quickly to resume normal (or otherwise acceptable) following.

When, however, averaged signals 48C, 58C from signals 48A, 58A from outboard and inboard angle sensors 47, 57 indicate to computer 66 that shuttle 30 is too far behind with respect to the leading wrap of cable 11 on drum 12, then normal following is halted. This condition might result from a length of cable 11 between rollers 35, 36 being bigger, or of greater width than the width of the length of cable 11 already wound in the leading wrap on drum 12. In this case computer 66 sends error feedback control signals 66D to the motor controller card of stepper motor controller 68. Stepper motor controller 68 sends stepper motor error feedback control signals 68D to stepper motor diver 69 that couples appropriate error position feedback driver signals 69D to jog stepper motor 27 forward. Error position feedback control signals 66D thereby command stepper motor 27 to jog forward a predetermined distance very quickly so that ball screw 28 moves shuttle 30 (and cable 11) forward a predetermined distance very quickly and normal following is resumed. The predetermined distance that shuttle 30 is jogged back or forward is dependant on the current width of cable 11 that passes through outboard and inboard sensors 40, 50 on shuttle 30. The process of jogging is repeated each wrap until shuttle 30 is determined to be in the optimal position. A jogging action will occur no more than one time per rotation of drum 12 to prevent overcompensation by levelwinding system 10.

Shuttle 30 changes the direction of its bidirectional travel as stepper motor 27 rotates ball screw 28, and the moving shuttle 30 contacts limit switches 29 on vertical members 23, 24 (the location of switches 29 on vertical members 23, 24 correspond to the location of opposite ends 12B and 12C of drum 12). Limit signal 29A produced by contacted, or activated switch 29 is fed to stepper motor controller 68. Controller 68 sends a stepper motor controller signal 68B to driver 69 that sends a stepper motor driver signal 69B to stepper motor 27. Stepper motor 27 changes direction to rotate ball screw 28 in the opposite direction to displace shuttle 30 in the opposite linear direction to begin winding (or unwinding) the next layer of cable 11 along the length of drum 12.

Active feedback levelwind system 10 of the invention has an inherent flexibility to accommodate cables of any width or cables of varying width such as marine cables that are faired. Furthermore, active feedback levelwind system 10 can adapt to changes in cable 11 by merely having computer 66 altered with a simple programming change instead of a costly mechanical redesign as is the case with contemporary mechanical systems. Active feedback levelwind system 10 utilizes active feedback to maintain shuttle 30 in its optimal position for a smooth wrap. If cable 11 does demonstrate gapping or bunching tendencies, feedback levelwind system 10 will detect and remedy these conditions. Graphical interfaces for the operator can be provided to give a complete real-time picture of the process of wrapping a cable. For example, rotational counter signals 17A can give indications of speed so that an operator can speed-up, slow down, or stop the winding or unwinding process by manual controls 62C, 62D, 62E. Outboard and inboard sensor signals 48A and 58A (or averaged signals 48C, 58C) can provide a visual indication of location of sensors on cable 11 or excessive variations or anomalies in geometry of cable 11 that may not be reliable wrapped. A visual or audio alarm could be triggered by such conditions to alert an operator of a potentially hazardous condition (an unusually large variance in cable geometry, for example) for immediate action, or an automatic shutdown could be initiated.

System 10 has also shown significant weight and size reductions over contemporary mechanical designs and eliminates the need for a heavy, expensive grooved drum by allowing hard-faired cable to be wrapped on top of bare or soft-faired cable. Usually, mechanical systems of the prior art transfer the rotations of the drum by a levelwind mechanism with a chain drive or gear system that must be adequately covered to protect an operator from becoming entangled in the moving parts. These safety features add significant size, weight, and cost. Active feedback levelwind system 10 of the invention replaces the chain drive and gear system with a relatively compact and inexpensive stepper motor and a common 8086 Windows-style computer. Many constituents of system 10 can be made by proven, inexpensive off-the-shelf technologies available to consumers and can be purchased from numerous vendors.

Although a specific embodiment of this inventive concept has been described that lends itself for deployment and retrieval of a cable for use in the ocean, it is apparent that many other applications could be made for stowing and deploying flexible elongate members in accordance with this invention. For example, the invention could be advantageously used to handle a wide variety of long hose-like oceanographic sensory systems that may have gathered fouling during long periods of deployment. Other applications might be those that deploy and retrieve elongate flexible conduits for irrigation systems, POL systems, and liquid and slurry handling systems for manufacturing and distribution, particularly where such conduits may wear or accumulate layers of removable grime and filth or otherwise gather materials that change their dimensions along their lengths. Many other applications for active feedback levelwind system 10 of the invention will become apparent to one skilled in the art. Inboard and outboard sensor assemblies 40, 50 could be modified to handle and guide a cable. The disclosed arrangements of guides, rollers, and sensors of levelwind assembly 20 are not to be construed as limiting, and the disclosed computer system and supporting structures including but not limited to the platforms, frameworks, and drums for stowage of cables thereon can be varied in design, arrangement, and orientation and still come within the scope of the levelwind system and method of this invention.

The disclosed components and their arrangements as disclosed herein, all contribute to the novel features of this invention. Levelwind system, 10 and method thereof are reliable, cost-effective, modifiable to safely and efficiently wind cables having with different lateral dimensions. Differently sized cable can be accommodated on-the-job without calling for extensive, costly modification and without slowing or stopping retrieval of deployed cables that may have extensive fouling. Therefore, levelwind system 10, as disclosed herein is not to be construed as limiting, but rather, is intended to be demonstrative of this inventive concept.

Obviously, many modifications and variations of the invention are possible in light of the above teachings. It is therefore to be understood that within the scope of the appended claims the invention may be practiced otherwise than as has been specifically described.

We claim:

1. An apparatus for winding cable in adjacent wraps on a drum comprising:

a drum to wrap cable thereon, said drum having a rotary encoder to provide signals representative of rotation;

a platform disposed adjacent to said drum, said platform having a shuttle receiving said cable and being bidirectionally moved to wrap said cable along said drum;

an outboard sensor assembly on said shuttle extending outboard from said shuttle away from said drum to receive an outboard extending portion of said cable, said outboard sensor assembly having an angular sensor to provide signals representative of angular orientation of said outboard extending portion;

an inboard sensor assembly on said shuttle extending inboard from said shuttle toward said drum to receive an inboard extending portion of said cable, said inboard sensor assembly having an angular sensor to provide signals representative of angular orientation of said inboard extending portion to said drum; and means on said platform connected to said shuttle for bidirectionally displacing said shuttle and said cable in response to said rotation signals, said outboard angular signals and said inboard angular signals.

2. The apparatus of claim 1 further comprising:

a limit switch at each end of said platform, said limit switch providing a limit signal when contacted by said shuttle.

3. The apparatus of claim 2 further comprising:

a pair of guide rollers mounted on said shuttle to guide said cable between them.

4. The apparatus of claim 3 wherein said outboard angular sensor signals and said inboard angular signals partially represent contact between said cable and at least one of said guide rollers to assure control of wrapping of said cable on said drum.

5. The apparatus of claim 4 wherein said platform includes a pair of guide shafts extending between said ends of said platform, said shuttle engaging said guide shafts for sliding bidirectional linear displacements thereon.

6. The apparatus of claim 5 wherein said bidirectionally displacing means includes a rotative stepper motor on said platform, a threaded ball screw on said platform, and a mating guide nut on said shuttle.

7. The apparatus of claim 6 wherein said stepper motor is rotated to rotate said threaded ball screw to create said bidirectional linear displacements of said shuttle, said guide rollers, said outboard angular sensor, and said cable along said drum.

8. The apparatus of claim 7 wherein rotation of said stepper motor and said threaded ball screw is in a predetermined ratio to rotations of said drum.

9. The apparatus of claim 8 further comprising:

a computer system coupled to receive said rotation signals, said outboard angular signals, said inboard angular signals, and said limit signals, to produce stepper motor driver signals to create said bidirectional linear displacements.

10. The apparatus of claim 9 wherein rotational speed of said stepper motor is changed to place said cable in contact with one of said guide rollers when said computer system determines said outboard angular signals and said inboard angular signals indicate failure of contact between said cable and at least one of said rollers.

11. The apparatus of claim 10 wherein said outboard angular signals and inboard angular signals are averaged in said computer system to provide stable angle measurement of said outboard angular sensor and said inboard angular sensor.

12. The apparatus of claim 11 wherein said computer system determines an optimum relationship of said shuttle to a leading wrap of said cable from said outboard angular signals and said inboard angular signals and creates said rotational control signals for said stepper motor driver to maintain a predetermined rate of said bidirectional linear displacements by said stepper motor.

13. The apparatus of claim 12 wherein said computer system produces error position feedback control signals from some of said outboard angular signals and said inboard angular signals for said stepper motor driver.

14. The apparatus of claim 13 wherein said error position feedback control signals are created in said computer system to correct said bidirectional linear displacements of said shuttle and said cable by said stepper motor for anomalies in the wrap of said cable on said drum.

15. The apparatus of claim 14 wherein said error position feedback control signals are created in said computer system to correct relationships of said shuttle with respect to a leading wrap of said cable on said drum for portions of said cable having different widths.

16. The apparatus of claim 15 wherein some of said error position feedback control signals are created in said computer system to halt rotation of said stepper motor and jog-back said stepper motor a predetermined number of revolutions corresponding to a predetermined distance for said shuttle and said cable.

17. The apparatus of claim 16 wherein said halting and jogging back of said stepper motor occurs when a portion of said cable becomes thinner and said computer system determines said inboard angular signals indicate said shuttle is too far ahead of said leading wrap.

18. The apparatus of claim 17 wherein some of said error position feedback control signals are created in said computer system to jog-forward said stepper motor a predetermined number of revolutions corresponding to a predetermined distance for said shuttle and said cable.

19. The apparatus of claim 18 wherein said jogging forward occurs when a portion of said cable becomes wider and said computer system determines said inboard angular signals indicate said shuttle is too far behind of said leading wrap.

20. The apparatus of claim 19 wherein said jogging back and jogging forward are repeated for a cable having successively varying widths to assure a smooth wrap on said drum.

21. A method using a computer system for winding a cable of varying width on a drum comprising the steps of:

rotating a drum for stowing a cable thereon;

generating signals representative of rotational speed of said drum;

guiding said cable through a pair of rollers on a levelwind assembly adjacent said drum;

generating signals representative of angle of a portion of said cable with respect to outboard of said levelwind assembly;

generating signals representative of angle of a portion of said cable with respect to a leading wrap of said cable on said drum inboard of said levelwind assembly;

coupling said rotational speed signals, said outboard angle signals, and said inboard angle signals to a computer system;

producing driver signals in said computer system in response to said rotational speed signals, said outboard angle signals, and said inboard angle signals; and displacing a shuttle of said levelwind assembly along said drum by said driver signals to wind said cable on said drum.

22. The method of claim 21 further comprising the steps of:

averaging said outboard angle signals and said inboard angle signals in said computer system; and coupling said limit signals to said computer system.

23. The method of claim 22 wherein said step of averaging provides stable angle measurement of an outboard angle sensor and an inboard angle sensor.

24. The method of claim 21 further comprising the step of:

generating signals representative of limits of travel of said shuttle adjacent said drum.

25. The method of claim 24 wherein said limit signals reverse the direction of said travel of said shuttle.

26. The method of claim 25 wherein said step of displacing comprises the steps of:

rotating a stepper motor coupled to said levelwind assembly by said driver signals to rotate a ball screw connected to said stepper motor; and linearly displacing said shuttle along said drum by rotating said ball screw in response to said driver signals.

27. The method of claim 26 further comprising the steps of:

comparing said outboard angle signals and said inboard angle signals with values preprogrammed into memory in a computer in said computer system; and determining in said computer contact of said cable with at least one of a pair of guide rollers on said shuttle to maintain positive control of said cable for wrapping said cable on said drum.

28. The method of claim 27 further comprising the steps of:

determining from said outboard angle signals and said inboard angle signals in said computer failure of contact between said cable and at least one of said guide rollers; and changing rotational speed of said stepper motor; and placing said cable in contact with at least one of said guide rollers to assure control of wrapping of said cable on said drum.

29. The method of claim 28 further comprising the steps of:

determining from said outboard angle signals and said inboard angle signals in said computer an optimum relationship of said shuttle to a leading wrap of said cable; and creating driver signals in said computer system to maintain a predetermined rate of linear displacements of said shuttle by said stepper motor to maintain said optimum relationship.

30. The method of claim 29 further comprising the step of:

creating error position feedback control signals from some outboard angle signals and inboard angle signals in said computer system, said error position feedback signals being representative of anomalies in the wrap of said cable on said drum.

31. The method of claim 30 wherein said error position feedback control signals cause displacements Of said shuttle by said stepper motor to change the position of said shuttle and a portion of said cable with respect to a leading wrap of said cable on said drum for portions of said cable having different widths.

32. The method of claim 31 further comprising the steps of:

halting rotation of said stepper motor by some error position feedback signals; and jogging back said stepper motor a predetermined number of revolutions corresponding to a predetermined distance for said shuttle.

33. The method according to claim 32 wherein said steps of halting and jogging back of said stepper motor occur when a portion of said cable is thinner and said computer system determines from said outboard angle signals and said inboard angle signals said shuttle is too far ahead of said leading wrap.

34. The method of claim 33 further comprising the step of:

jogging forward said stepper motor a predetermined number of revolutions corresponding to a predetermined distance for said shuttle.

35. The method of claim 34 wherein said step of jogging forward occurs when a portion of said cable is wider and said computer system determines from said outboard angle signals and said inboard angle signals said shuttle is too far behind of said leading wrap.

36. The method according to claim 35 wherein said steps of halting, jogging back and jogging forward are repeated for a cable having successively varying widths to assure a smooth wrap on said drum.

* * * * *